US005256217A

United States Patent [19]

Macheske

[11] Patent Number: 5,256,217

[45] Date of Patent: Oct. 26, 1993

[54] MULTI-SURFACE FLAME HARDENING MACHINE AND PROCESS

[75] Inventor: Robert L. Macheske, Tawas City, Mich.

[73] Assignee: CMI International, Southfield, Mich.

[21] Appl. No.: 885,290

[22] Filed: May 18, 1992

[51] Int. Cl.[5] ..... B23K 7/10

[52] U.S. Cl. ..... 148/642; 266/61; 266/124

[58] Field of Search ..... 266/61, 124, 261; 148/641, 642

[56] References Cited

U.S. PATENT DOCUMENTS

| | | | |
|---|---|---|---|
| 2,170,876 | 8/1939 | Shorter | 266/124 |
| 2,196,902 | 4/1940 | Jones | 148/642 |
| 2,828,119 | 3/1958 | Good et al. | 266/124 |
| 3,445,097 | 5/1969 | Quinn | 266/261 |

*Primary Examiner*—Scott Kastler

*Attorney, Agent, or Firm*—Reising, Ethington, Barnard, Perry & Milton

[57] ABSTRACT

An apparatus (10) for heat treat hardening multiple wear surfaces (24,26,28) of a metal workpart (14). Flame burners (38) and associated trailing quenches (36) travel along a linear and vertical path (13) across the workpart (14) to flame harden the wear surfaces (24,26,28) thereon. The workpart (14) is mounted on support studs (60) extending from a turntable (52), and clamping arms (66) securely engage the workpart (14) with the support studs (60). The turntable (52) rotates the workpart (14) relative to the travel path (13) of the flame burners (38) to move flame hardened surfaces (24,26,28) out of the travel path (13) and move unhardened surfaces (24,26,28) into the travel path (13) for flame hardening by the flame burners (38).

48 Claims, 5 Drawing Sheets

FIG-3
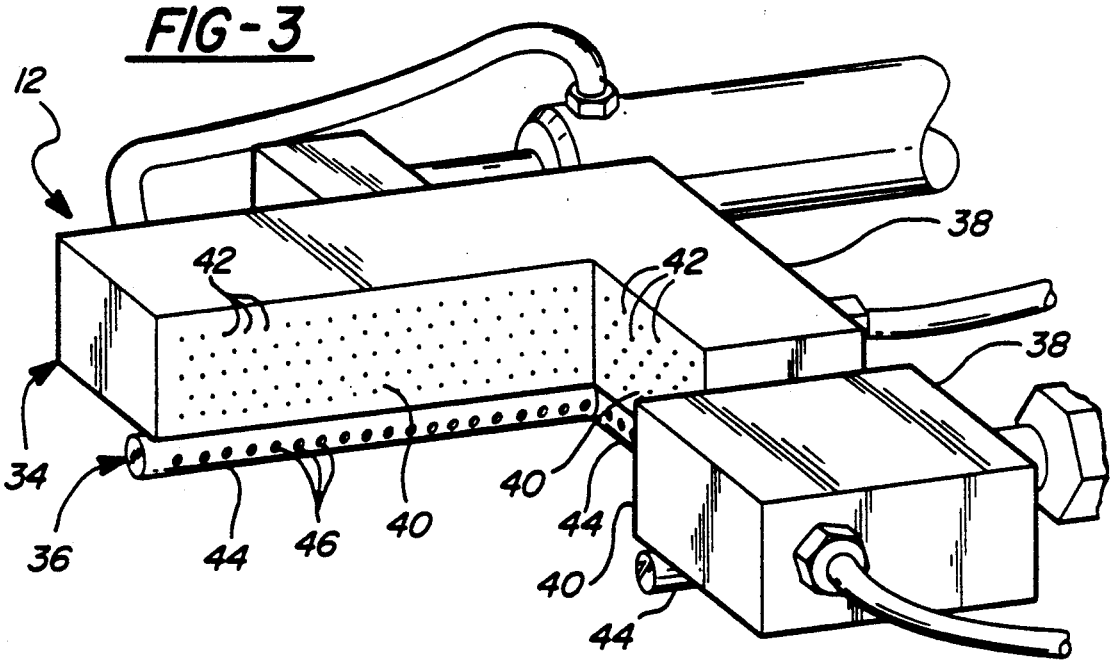
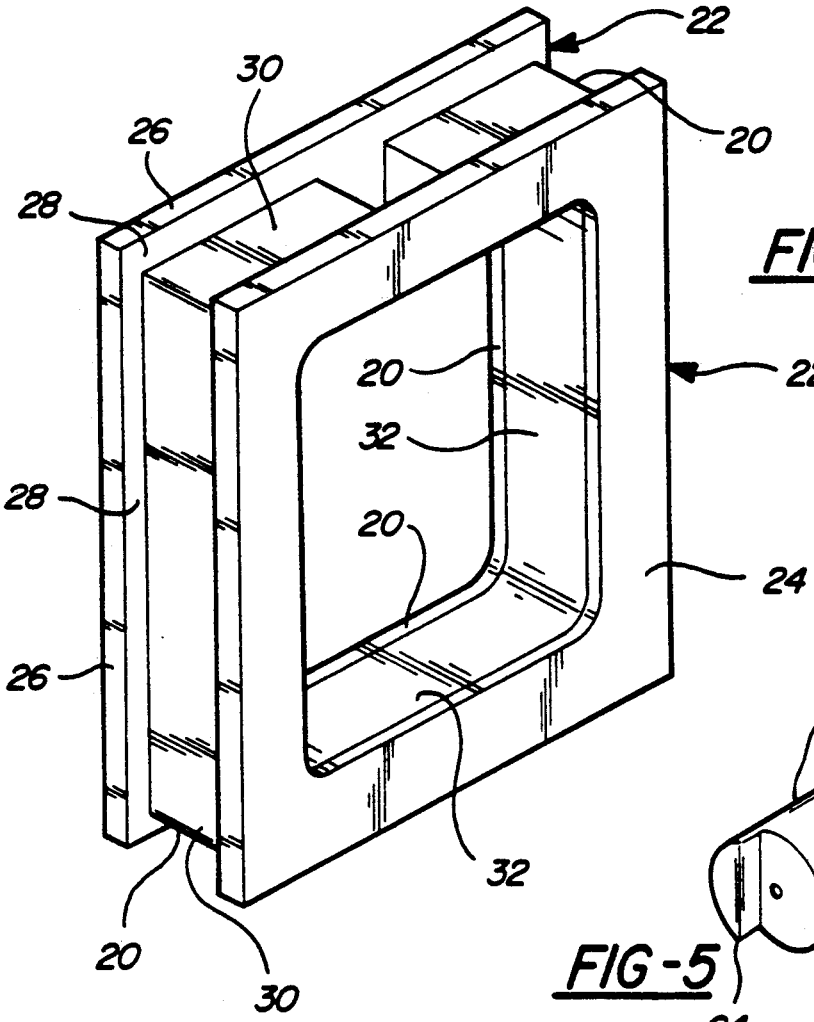
FIG-4
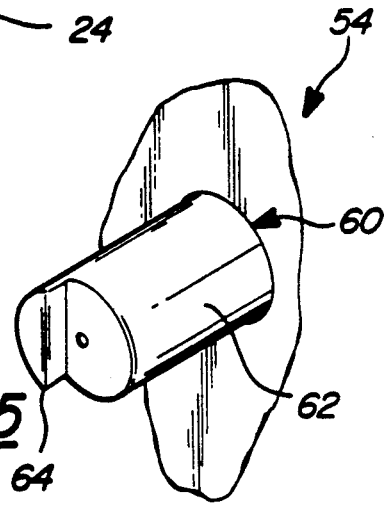
FIG-5

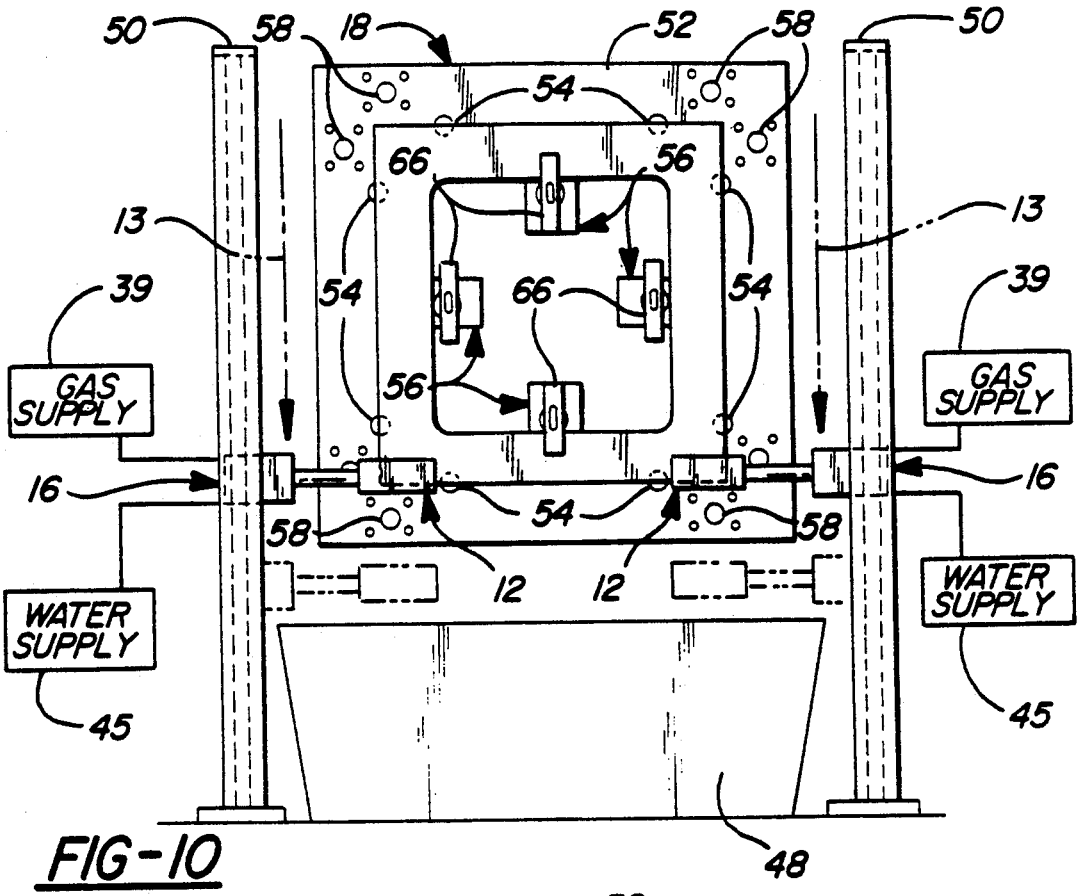
FIG-10
FIG-11
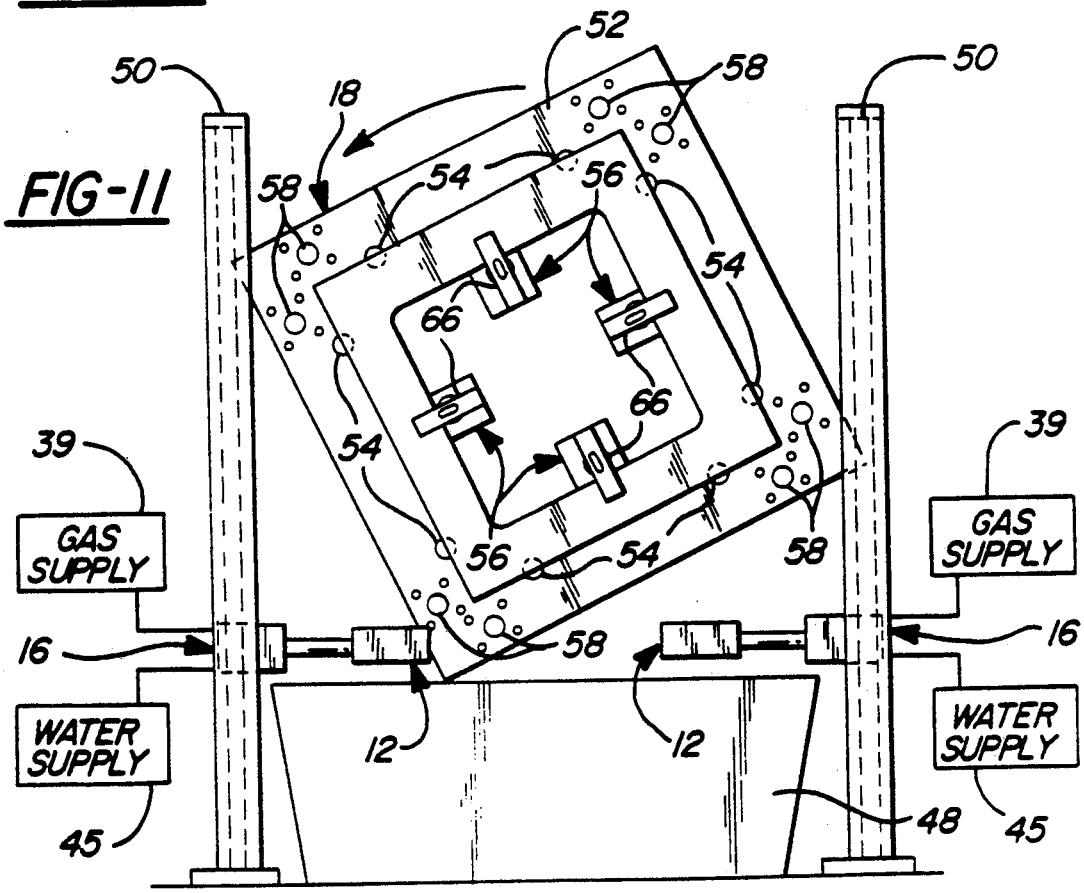

MULTI-SURFACE FLAME HARDENING MACHINE AND PROCESS

TECHNICAL FIELD

The subject invention relates to a heat treat hardening assembly for heat treat hardening multiple sides of a metal workpart. More specifically, the invention relates to a flame hardening assembly for flame hardening multiple wear surfaces on each side of the workpart.

BACKGROUND ART

Heat treat hardening is a well known and convenient method for increasing the hardness and durability of a metal surface. A basic heat treat hardening assembly includes a heating device, such as an acetylene torch, and a quenching fluid such as water. By passing the torch over the surface and immediately quenching the heated surface, a hardened skin is produced on the metal. This hardened surface is much more resistant to wear and damage than an untreated metal surface.

The standard heating devices produce localized heating, such as an acetylene torch. Thus, there is a need for relative motion between the heating device and the workpart to permit the device to travel across a surface to be hardened. Generally, either the workpart or the heating device move along a predetermined travel path to provide relative motion therebetween and permit heating of the workpart surface. The travel path required is, of course, dependent upon the shape of the workpart.

For a workpart having multiple surfaces to be hardened this can be a complicated, labor intensive task. For example, a metal foundry casting flask is a workpart of this type. The casting flasks are generally four-sided, box-like members with multiple surfaces to be hardened on each side. Typically, the flask would be placed flat on a support surface and multiple passes by the heat treat hardening device would be required to harden the multiple surfaces on each side. The heat treat hardening device would then be moved to harden surfaces on another side of the flask. After all four sides had been flame hardened, the flask would then be turned over to access the wear surfaces that were previously resting on the support surface and were thus inaccessible. The prior art does not show an apparatus or method to flame harden workparts of this type in one simplified process.

For example, U.S. Pat. No. 2,867,556 to Tegen discloses a flame hardening apparatus including gas nozzles which surround multiple surfaces on a metal rail. The nozzles emit a quantity of flammable gasses which, when ignited, provide a sufficient heating source to heat treat the surface of the rail. Since the apparatus is designed to flame harden long metal rails, the apparatus moves along a linear travel path above the rail. A leading quench and a following quench are disposed on opposite sides of the nozzles and provide a flow of quenching fluid onto the rail. This apparatus does not lend itself, however, to flame hardening workparts requiring a non-linear, multi-directional travel path of the flame hardening device.

This problem has been addressed with regard to circular workparts in U.S. Pat. No. 1,711,835 to Davis. The '835 reference discloses a flame hardening assembly including two torch members disposed on opposite sides of a drum shaped workpart. The workpart rotates with respect to the torch members to provide even, uninterrupted heating of the workpart. The workpart is partially supported in a tank of quenching fluid, and as a surface of the workpart is heated the rotation immediately carries the heated surface into the tank. Thus, the apparatus can flame harden a workpart that requires a non-linear travel path thereof relative to the torch members. However, this reference is not suitable for non-circular workparts or workparts requiring a complex travel path of the heating device with respect to the workpart. Specifically, the prior art does not teach a method or apparatus that would be capable of flame hardening a multi-sided workpart such as a casting flask.

SUMMARY OF THE INVENTION AND ADVANTAGES

The present invention provides an apparatus for heat treat hardening multiple wear surfaces of a metal workpart. The apparatus comprises a heat treat hardening means for heat treat hardening the multiple wear surfaces of the workpart. A moveable support means is also included for supporting the heat treat hardening means for travel along a predetermined travel path. The invention is characterized by workpart support means for supporting a first of the wear surfaces in position along the travel path for heat treat hardening by the heat treat hardening means and for selectively moving the workpart relative to the heat treat hardening means to move the first wear surface out of the travel path and to bring a second wear surface into the travel path for subsequent heat treat hardening thereof.

The invention also contemplates a method for heat treat hardening multiple wear surfaces of a metal workpart with a heat treat hardening assembly supported for movement along a predetermined travel path. The method comprises the steps of supporting a first wear surface of the workpart along the travel path of the heat treat hardening assembly; moving the heat treat hardening assembly along its predetermined travel path to heat treat harden the first wear surface; and selectively moving the workpart relative to the heat treat hardening assembly to move the first hardened surface of the workpart out of the travel path and bring a second wear surface of the workpart into the travel path for heat treat hardening thereof.

The present invention improves upon the prior art by permitting flame hardening of a workpart with a complicated perimeter, such as a foundry casting flask, in one simplified operation. The heat treat hardening means can utilize a simple travel path and rely on the workpart support means to bring each surface to be hardened within the travel path. This coordination between the workpart support means and moveable support means provides for flame hardening of workparts with complex shapes in one uninterrupted process.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a perspective view of a flame burner of the preferred embodiment;

FIG. 4 is a perspective view of a metal foundry flask workpart;

FIG. 5 is a perspective view of a mounting stud of the preferred embodiment;

FIG. 10 is a front view of the apparatus of FIG. 8 in the process of flame hardening the workpart; and FIG. 11 is a front view like FIG. 10 showing the workpart being rotated to position another surface of the workpart along the travel path of the flame burners.

DETAILED DESCRIPTION OF THE PREFERRED EMBODIMENT

Figure 1:
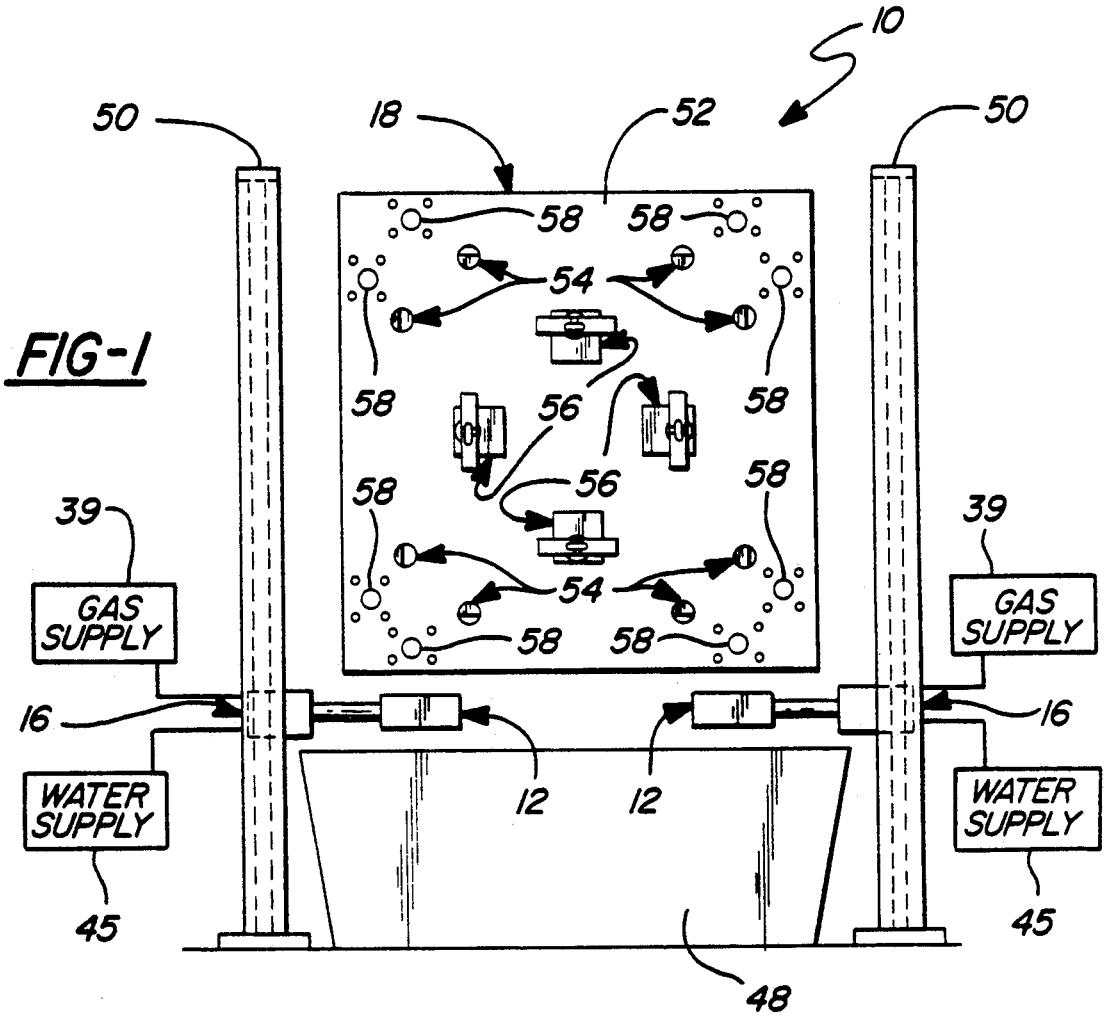
FIG. 1 is a front view of an apparatus constructed according to the present invention.
Figure 2:
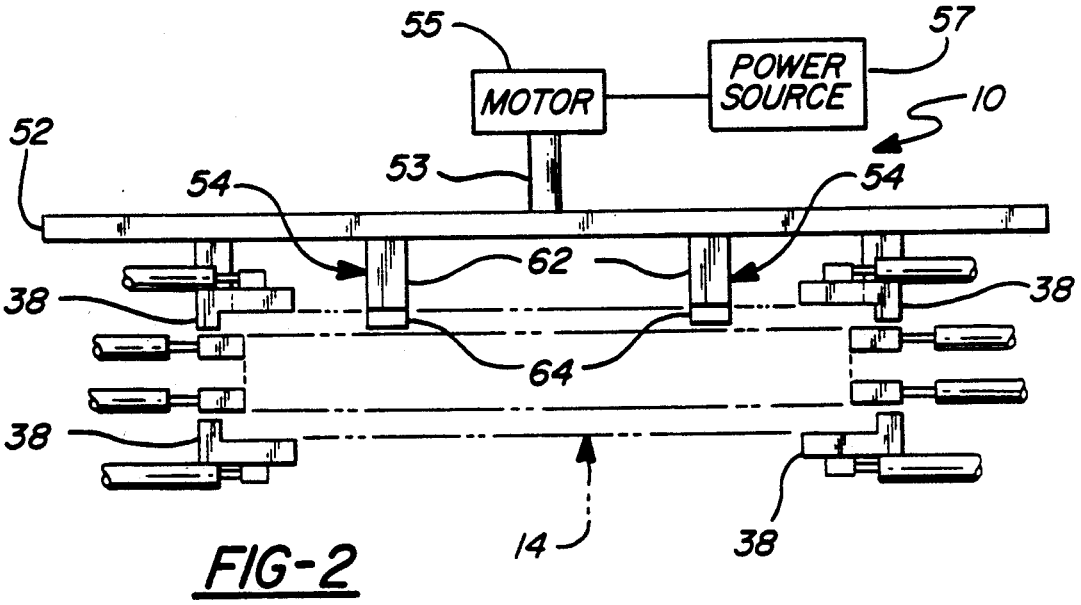
FIG. 2 is a top view of the apparatus of FIG. 1.

An apparatus for heat treat hardening multiple wear surfaces of a metal workpart is generally shown at 10 in the figures. The apparatus 10 includes heat treat hardening means 12 for heat treat hardening multiple wear surfaces of a workpart 14. Moveable support means 16 are also included for supporting the heat treat hardening means 12 for travel along a predetermined travel path 13. Workpart support means 18 are provided for supporting a first of the wear surfaces of the workpart 14 in position along the travel path 13 for heat treat hardening by the heat treat hardening means 12 and for selectively moving the workpart 14 relative to the heat treat hardening means 12 to move the first wear surface out of the travel path 13 and to bring a second wear surface into the travel path 13 for subsequent heat treat hardening thereof as will be described in greater detail below.

The assembly 10 of the preferred embodiment is particularly suited for heat treat hardening metal foundry flasks, as shown at 14 in FIG. 4. The flask 14 is generally square or boxlike with four symmetrical side walls 20 sandwiched between two planar end plates 22. In this manner, the non-contiguous sides 20 are parallel and the contiguous sides 20 are perpendicular. The end plates 22 are four sided and each side includes an outer surface 24, side edge 26, and inner surface 28. The side walls 20 each include an outer face 30 and an inner face 32. The end plates 22 are flush with the inner face 32 of the side walls 20 but overlap the outer face 30. Thus, if the flask 14 is placed on a flat surface the end plates 22 will completely support the side walls 20 preventing any contact between the side walls 20 and the flat surface. Accordingly, the end plates 22 are subject to wear during movement or handling of the flask 14 whereas the side walls 20 are not. It is therefore advantageous to heat treat harden the wear surfaces of the end plates 22, in particular the outer surfaces 24, side edges 26, and inner surfaces 28, to increase the durability thereof.

The heat treat hardening means 12 is shown in FIG. 3 and includes heating means 34 for heating the wear surfaces 24,26,28 of the workpart 14 and trailing quenching means 36 for immediate and subsequent cooling of the heated wear surfaces 24,26,28. The heating means 34 and quenching means 36 operate together to heat treat harden the wear surfaces 24,26,28 of the workpart 14.

The heating means 34 of the preferred embodiment comprises a plurality of flame burners 38 that use a combustible gaseous fuel to produce a flame. In the preferred embodiment the gas is provided by a gas source 39 and comprises an oxygen/acetylene mixture, although any sufficiently flammable gas would be adequate. The flame burners 38 each include three distinctly oriented (i.e. non-planar) nozzle surfaces 40 designed to surround the outer surface 24, side edge 26, and inner surface 28 of one side of an end plate 22. In this manner, a flame burner 38 travelling along an end plate 22 will completely cover and flame harden the aforementioned wear surfaces 24,26,28. The wear surfaces 24,26,28 on the end plates 22 that correspond to a given side of the workpart 14 are simultaneously flame hardened by two separate but coordinated flame burners 38. Two additional flame burners 38 flame harden the wear surfaces 24,26,28 on the opposing side of the workpart 14. In this manner, four flame burners 38 are used to simultaneously flame harden the wear surfaces 24,26,28 on two opposing sides of the workpart 14. The nozzle surfaces 40 on the flame burners 38 each comprise a planar surface with a plurality of small, spaced apertures 42 for controlled release of flammable gasses in a predetermined burning pattern. The flame burners 38 are thus hollow to allow for gas to enter therein and exit through the apertures 42.

The quenching means 36 is mounted directly below and in fixed relationship to the heating means 34 and supported thereat by the moveable support means 16. The quenching means 36 comprises a perforated pipe 44 including three distinctly oriented, non-planar sections. This enables the pipe 44 to fit directly beneath each distinctly oriented, nozzle surface on the heating means 34. Water or another suitable quenching fluid is pumped through the pipe 44 from a water supply 45 and exits through perforations 46 in the pipe 44. The size and shape of the perforations 46 determine the spray pattern of the quenching fluid and can be varied as desired. The location of the quenching pipe 44 directly adjacent the flame burners 38 permits immediate quenching of heated surfaces 24,26,28 on the workpart 14 as the flame burner 38 travels across the workpart 14.

The moveable support means 16, as shown in FIG. 1 supports the heating means 34 and quenching means 36 for movement along the predetermined, linear and vertical travel path 13. The vertical path of the heating means 34 and quenching means 36 is advantageous to the quenching process as excess quenching fluid will not pool on the workpart 14. Rather, the quenching fluid will be emitted by the quenching means 36, quench the heated surface, and then fall away from the workpart 14 into a basin 48 disposed beneath the workpart support means 18.

The moveable support means 16 comprises a vertical guide post assembly 50 for each pair of flame burners 38. The guide post assembly 50 thus establishes the aforementioned vertical linear travel path 13. A drive means (not shown) is mounted on the guide post assembly 50 for moving the flame burners 38 together as a unit vertically along the guide post assembly 50.

The workpart support means 18 is shown in FIG. 1 and comprises a turntable 52 supported vertically about a rotatable horizontal shaft 53 coupled to a drive means 55 for imparting rotation to the shaft 53 and turntable 52 in relation to the fixed vertical travel path 13 of the heat treat hardening means 12. The drive means 55 includes a motor 55 which is powered by a power source 57. The turntable 52 is a square planar member provided with workpart suspension means 54 for suspending the workpart 14 a predetermined distance away from the turntable 52. A workpart clamping means 56 is also included for securely clamping the workpart 14 to the workpart suspension means 54 for rotation with the turntable 52. The turntable 52 includes a plurality of spaced openings 58 through which the workpart suspension means 54 is disposed. Additional openings 58 are provided for accomodating flasks 14 or variable sizes.

The workpart suspension means 54 comprises a plurality of support studs 60 as shown in FIG. 5 for supporting the workpart 14 vertically on edge and away from the turntable 52 to provide sufficient clearance between the turntable 52 and the workpart 14 for enabling passage of the flame burner 38 as it moves along its vertical travel path 13. The support studs 60 each comprise a cylindrical shaft or base 62 with a raised support lip 64 on the distal end thereof. The support lips 64 are positioned to support the outer periphery of the workpart 14 and thus form a "cradle" in which the workpart 14 lies. In addition, the support studs 60 are selectively extendable and retractable relative to the turntable 52 toward and away from engagement with the flask 14. In the preferred embodiment, two support studs 60 are used for each side of the workpart 14 and are positioned proximate the ends of their respective sides of the workpart 14. In other words, a total of eight support studs 60 are used and are positioned proximate the corners of the workpart 14. By spacing the support studs 60 in this manner and by using two studs 60 per side of the workpart 14, the workpart 14 is stabilized against rocking or other movement relative to the turntable 52.

Figure 6:
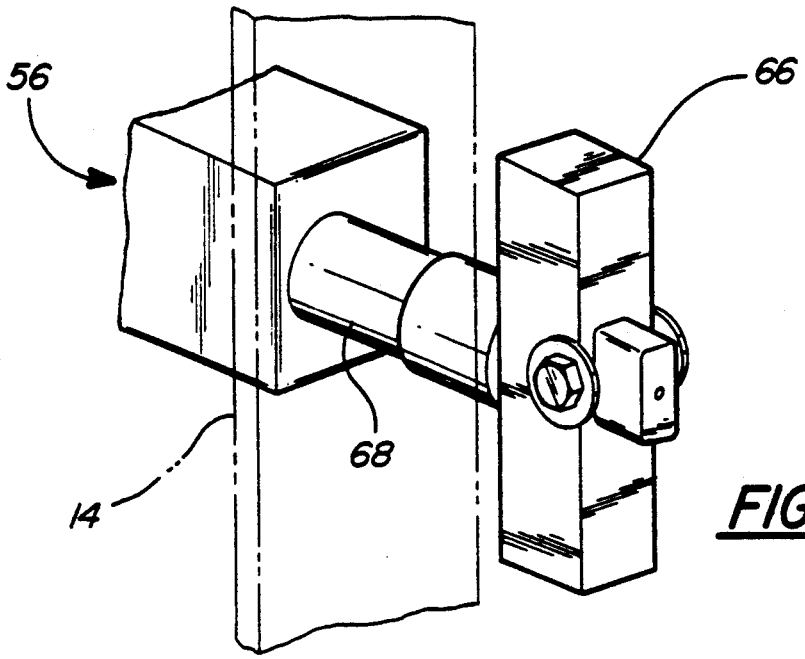
FIG. 6 is a perspective view of a clamping arm of the preferred embodiment.
Figure 7:
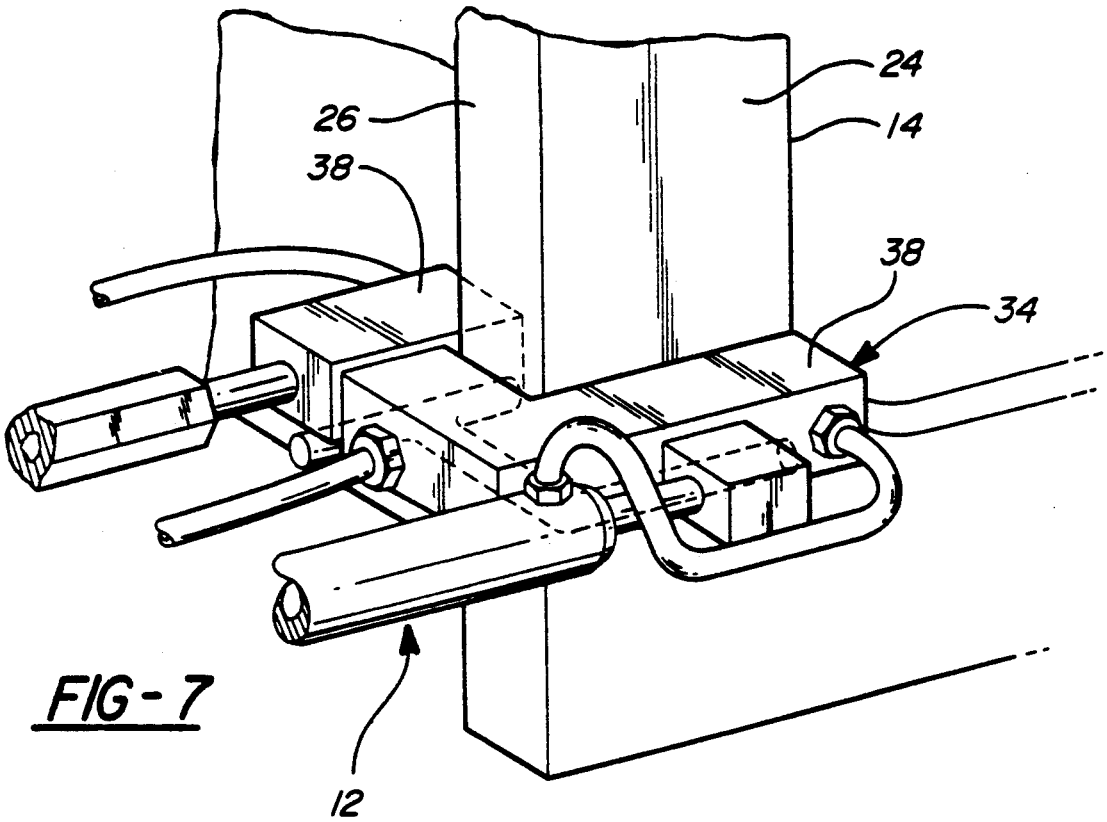
FIG. 7 is a perspective view of the flame burner engaged with the workpart and heat treat hardening the workpart.

The workpart clamping means 56 is shown in detail in FIG. 6 and comprises four selectively rotatable and extendable clamping arms 66 carried by the turntable 52 for selectively clamping each of the four sides of the workpart 14 against the workpart suspension means 54. The clamping arms 66 are mounted on an adjustable clamp support 68 for supporting the clamping arm a variable distance away from the turntable 52. In other words, when clamping a workpart 14 the adjustable clamp support 68 must first extend the clamping arms 66 a sufficient distance away from the turntable 52 to allow clearance between a workpart 14 mounted on the support studs 60 and the clamping arms 66. The clamping arms 66 then rotate into an overlapping position over the workpart 14, and the adjustable clamp support 68 retracts the clamping arms 66 into tight locking engagement with the workpart 14.

Figure 8:
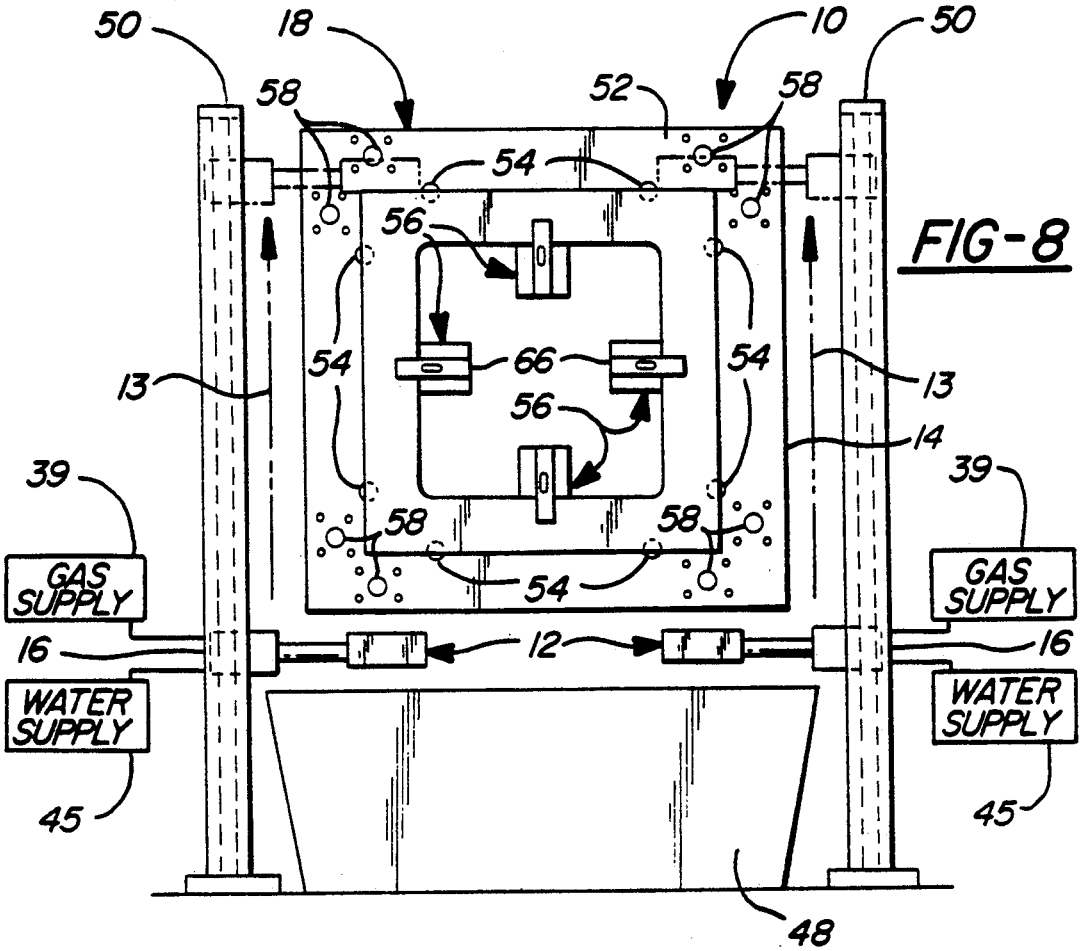
FIG. 8 is a front view of the workpart mounted on the apparatus of FIG. 1.

In operation, first the support studs 60 are extended a predetermined distance away from the turntable 52. Next, the wear surfaces 24,26,28 are supported along the travel path of the heat treat hardening means 12 by placing the workpart 14 (e.g. a foundry flask) on the support studs in a vertically suspended, outwardly spaced position away from the turntable 52. The adjustable clamp supports 68 then extend the clamping arms 66 a predetermined distance away from the turntable 52 to provide clearance of the clamping arms 66 over the flask 14. The clamping arms 66 are then rotated into an overlapping position over the flask 14, at which point the adjustable clamp supports 68 retract the clamping arms 66 into secure locking engagement with the flask 14. The flask 14 is thus securely engaged with the support studs 60 and is prevented from any movement relative to the turntable 52, as shown in FIG. 8. The flask 14 is supported such that two sides 20 are vertically disposed and two sides 20 are horizontally disposed. Accordingly, the multiple wear surfaces 24,26,28 on two sides of the flask 14 are positioned and supported along the travel path 13 of the heat treat hardening means 12. In particular, the wear surfaces 24,26,28 on the vertically disposed sides 20 are positioned along the travel path whereas the wear surfaces 24,26,28 on the horizontal sides 20 are not.

Figure 9:
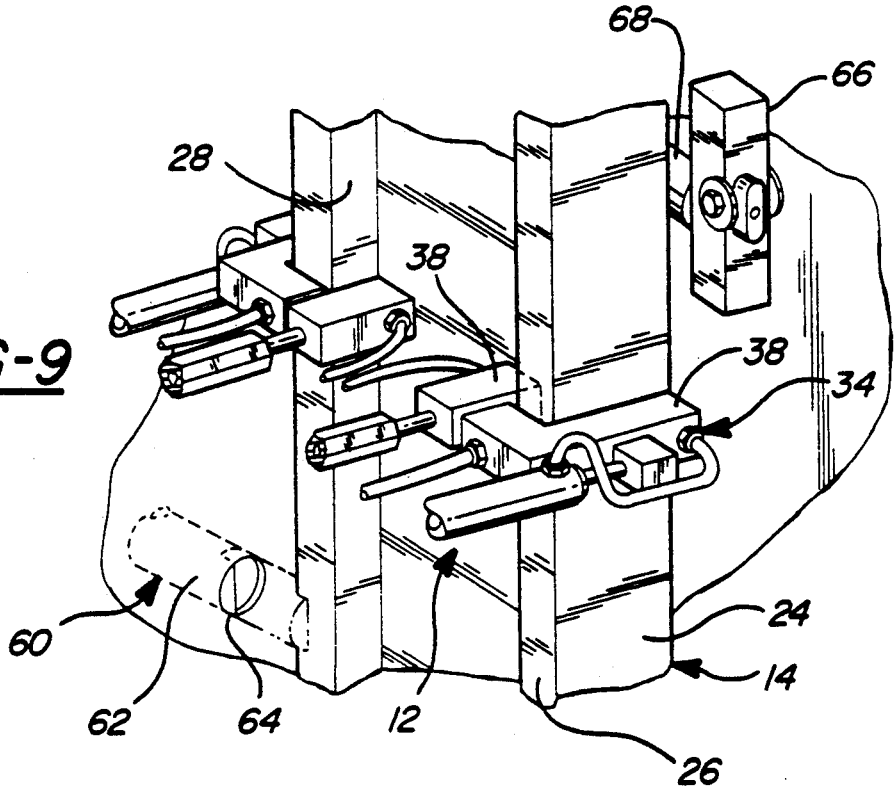
FIG. 9 is a perspective view of the workpart and apparatus of FIG. 8 with selected mounting studs and clamping arms retracted away from the workpart.

Turning to FIG. 9, after the flask 14 is securely in place on the turntable 52, the support studs 60 on the vertically disposed sides of the flask 14 within the travel path 13 of the heat treat hardening means 12 are retracted. In addition, the clamping arms 66 on the same two sides of the flask 14 are reextended, rotated and thereby dislocated out of the overlapping position with respect to the flask 14. This prevents the support studs 60 and clamping arms 66 from interfering with the heat treat hardening means 12 as it moves along its path 13. In addition, since the points of contact of the support studs 60 and clamping arms 66 lie on a small portion of the wear surfaces 24,26,28 on the flask 14, they must be removed to allow for complete flame hardening.

The next step involves heat treat hardening the wear surfaces 24,26,28 positioned within the travel path 13 by moving the heat treat hardening means 12 upwardly along the predetermined vertical travel path 13, as shown in FIG. 20. In other words, the flame burners 38 move upwardly along linear and vertical travel paths 13 and simultaneously heat the multiple, non-planar wear surfaces 24,26,28 on the vertically disposed sides of the flask 14 within the travel paths 13. The heated wear surfaces 24,26,28 are then quenched with the trailing quenching means 36 which immediately follows the flame burners 38 along the travel path 13 to complete the flame hardening process by rapidly cooling the heated surfaces 24,26,28.

Turning to FIG. 10, following the flame hardening, the support studs 60 that lie within the travel path 13 of the heat treat hardening means 12 (i.e., the support studs corresponding to the vertically disposed sides 20 of the flask 14) are reextended and engage the flask 14. In addition, the dislocated clamps 66 are reengaged with the flask 14 by following the aforementioned steps of extending, rotating, and retracting the clamping arms 66 into engagement with the flask 14. Once the flask 14 is secured, the flask 14 is selectively moved and rotated relative to the heat treat hardening means 12 as shown in FIG. 11 to move the already flame hardened wear surfaces 24,26,28 of the flask 14 out of the travel path 13 of the heat treat hardening means 12 and bringing the wear surfaces 24,26,28 on the remaining two sides of the flask 14 into the travel path 13. The flask 14 is moved by rotating the turntable 52 ninety degrees, as shown in FIG. 11, and thus the vertically disposed sides are repositioned horizontally and vice versa. The steps of retracting the studs, dislocating the clamping arms 66, and heat treat hardening the flask 14 are then repeated in successive iterative fashion.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus (10) for heat treat hardening multiple wear surfaces of a metal workpart (14), said apparatus (10) comprising:

heat treat hardening means (12) for heat treat hardening the multiple wear surfaces (24,26,28) of the workpart (14);

moveable support means (16) for moving said heat treat hardening means (12) in successive iterative trips along a travel path (13) (14) to heat treat harden successive wear surfaces of the workpart (14) placed within said travel path (13);

workpart support means (18) for supporting wear surfaces of the workpart (14) along said travel path (13) of said heat treat hardening means (12) and for selectively moving the workpart (14); and drive means (55) for intermittently rotating the workpart support means (18) in a partial revolution prior to each successive iterative trip of said heat treat hardening means (12) to remove a first heat-treated workpart surface from said travel path (13) while positioning a second untreated workpart surface along said travel path (13) for subsequent heat treat hardening thereof.

2. An apparatus (10) as set forth in claim 1 wherein said heat treat hardening means (12) comprises heating means (34) for heating the wear surfaces of the workpart (14) and trailing quenching means (36) for immediate and subsequent cooling of the heated wear surfaces.

3. An apparatus (10) as set forth in claim 2 wherein said travel path (13) is substantially linear and vertical.

4. An apparatus (10) as set forth in claim 1 wherein said heating means (34) is supported immediately above and in fixed relationship to said quenching means (36).

5. An apparatus (10) as set forth in claim 1 wherein said heating means (34) includes at least one flame burner (38).

6. An apparatus (10) as set forth in claim 5 wherein said flame burner (38) includes at least one nozzle surface (40).

7. An apparatus (10) as set forth in claim 6 wherein said nozzle surface (40) comprises a plurality of spaced apertures (42) for providing controlled mixture and release of flammable gasses in a predetermined burning pattern.

8. An apparatus (10) as set forth in claim 7 wherein said flame burner (38) includes a plurality of non-planar nozzle surfaces (40) for simultaneously heat treating a plurality of wear surfaces (24,26,28) of the workpart (14).

9. An apparatus (10) as set forth in claim 1 wherein said workpart support means (18) comprises a turntable (52) supported about a horizontal axis of rotation.

10. An apparatus (10) as set forth in claim 9 wherein said turntable (52) includes workpart suspension means for suspending the workpart (14) a predetermined distance away from said turntable (52).

11. An apparatus (10) as set forth in claim 10 wherein said turntable (52) includes workpart clamping means (56) for securely clamping the workpart (14) to said workpart suspension means (54).

12. An apparatus (10) as set forth in claim 11 wherein said workpart suspension means (54) comprises a plurality of support studs (60).

13. An apparatus (10) as set forth in claim 12 wherein at least some of said support studs (60) are selectively extendable and retractable relative to said turntable (52).

14. An apparatus (10) as set forth in claim 13 wherein said support studs (60) comprises a cylindrical shaft (62) with a raised support lip (64) thereon.

15. An apparatus (10) as set forth in claim 11 wherein said workpart clamping means (56) includes at least one rotatable clamping arm (66).

16. An apparatus (10) as set forth in claim 15 wherein said workpart clamping means (56) includes an adjustable clamp support (68) for supporting said clamping arm (66) a variable distance away from said turntable (52).

17. A method for heat treat hardening multiple wear surfaces of a metal workpart (14) with a heat treat hardening assembly (12) supported for movement along a travel path (13), said method comprising the steps of:

supporting a first wear surface of the workpart (14) along the travel path (13) of the heat treat hardening assembly (12);

heat treat hardening the first wear surface by moving the heat treat hardening assembly (12) with respect to the workpart (14) along the travel path (13) to heat treat harden the first wear surface;

thereafter selectively moving the workpart (14) relative to the heat treat hardening assembly (12) to move the hardened first wear surface of the workpart (14) out of the travel path (13) while bringing a second wear surface of the workpart (14) into the travel path (13) for heat treat hardening thereof; and heat treat hardening the second surface by moving the heat treat hardening assembly (12) along the travel path (13).

18. A method as set forth in claim 17 including quenching the heated surfaces of the workpart (14) with the heat treat hardening assembly (12).

19. A method as set forth in claim 18 including moving the heat treat hardening assembly (12) along a substantially linear and vertical travel path (13).

20. A method as set forth in claim 17 including supporting the workpart (14) on a turntable (52).

21. A method as set forth in claim 20 including rotating the turntable (52).

22. A method as set forth in claim 21 including extending support studs (60) a predetermined distance away from the turntable (52).

23. A method as set forth in claim 22 including mounting the workpart (14) on the support studs (60) in a suspended position away from the turntable (52).

24. A method as set forth in claim 23 wherein the turntable (52) includes a workpart clamping assembly (56), including extending the workpart clamping assembly (56) a predetermined distance away from the turntable (52).

25. A method as set forth in claim 24 wherein the workpart clamping assembly (56) includes clamping arms (66), including rotating the clamping arms (66) into an overlapping position over the workpart (14).

26. A method as set forth in claim 25 including retracting the workpart clamping assembly (56) until the clamping arms (66) securely engage the workpart (14).

27. A method as set forth in claim 26 including retracting preselected support studs (60) away from the workpart (14).

28. A method as set forth in claim 27 including dislocating preselected clamping arms (66) from contact with the workpart (14).

29. A method as set forth in claim 28 including reextending the support studs (60) in the travel path (13) of the heat treat hardening assembly (12) after the corresponding side of the workpart (14) has been heat treated.

30. A method as set forth in claim 29 including reengaging the dislocated clamping arms (66) with the workpart (14) after the corresponding side of the workpart (14) has been heat treated.

31. A method as set forth in claim 17 including simultaneously heat treat hardening multiple non-planar surfaces (24,26,28) on each side of the workpart (14).

32. A method as set forth in claim 17 including heating the surfaces of the workpart (14) with a flame burner (38).

33. A method as set forth in claim 17 including repeating said steps of supporting a surface of the workpart (14) in the travel path (13), moving the heat treat hardening assembly (12) along the travel path (13) to heat treat harden the surface, and moving the workpart (14) relative to the travel path (13) until all desired surfaces (24,26,28) on the workpart (14) are heat treated.

34. A method for heat treat hardening multiple wear surfaces of a metal casting flask (14) having four symmetrical sides (20) with multiple wear surfaces (24,26,28), said method comprising the steps of:

supporting the wear surfaces of at least a first one of the sides (20) along a generally linear travel path (13) of a heat treat hardening device (12);

moving the heat treat hardening device (12) along the travel path (13) and thereby heat treat hardening the wear surfaces of the first side;

thereafter rotating the casting flask (14) with respect to the device (12) to move the hardened wear surfaces of the first side out of the travel path (13) of the heat treat device (12) while positioning the wear surfaces of at least a second one of the sides into the travel path (13); and thereafter moving the heat treat hardening device (12) along the linear travel path (13) and thereby heat treat hardening the consecutive wear surfaces of the second side.

35. A method as set forth in claim 34 including moving the heat treat hardening device (12) along a vertical travel path (13).

36. A method as set forth in claim 35 including moving the heat treat hardening device (12) upwardly along the vertical travel path (13).

37. A method as set forth in claim 35 including moving a flame burner (38) and an associated trailing quenching device (36) along the vertical travel path (13) of the heat treat hardening device (12) to heat treat harden the flask (14).

38. A method as set forth in claim 35 including supporting the flask (14) such that two sides (20) are vertically disposed and two sides (20) are horizontally disposed.

39. A method as set forth in claim 37 including positioning the wear surface of each of the vertically disposed sides of the flask (14) along the vertical travel path (13) of the heat treat hardening device (12) and thereafter moving the device (12) along the travel path (13) to simultaneously heat treat harden the respective wear surfaces of both of the vertical sides.

40. A method as set forth in claim 37 including positioning multiple wear surfaces (24,26,28) of each of the vertically disposed sides of the workpart (14) along the vertical travel path (13) and thereafter moving the heat treat hardening device (12) along its travel path (13) to simultaneously heat treat harden the respective multiple wear surfaces (24,26,28) of each of the vertically disposed sides.

41. A method as set forth in claim 40 including rotating the flask (14) ninety degrees to reposition the previously horizontal sides (20) vertically and into the travel path (13) of the heat treat hardening device (12) and to reposition the previously vertical sides (20) horizontally and out of the travel path (13).

42. A method as set forth in claim 38 including supporting the flask (14) by engaging the vertical and horizontal sides with a first set of support studs (60) projecting outwardly from a vertically disposed turntable (52) whereby the flask (14) is spaced outwardly from the turntable (52).

43. A method as set forth in claim 42 including clamping the vertical and horizontal sides of the flask (14) against the support studs (60) with clamping arms (66) that project outwardly from the turntable (52).

44. A method as set forth in claim 43 including disengaging the support studs (60) from the vertically disposed sides to thereby remove the studs (60) from the travel path (13) of the heat treat hardening device (12).

45. A method as set forth in claim 44 including selectively clamping the flask (14) with the clamping arms (66) by extending the clamping arms (66) away from the turntable (52), rotating the clamping arms (66) to overlap the flask (14), and retracting the clamping arms (66) into engagement with the flask (14).

46. A method as set forth in claim 45 including disengaging the clamping arms (66) from the vertically disposed sides to remove the arms (66) from the travel path (13) of the heat treat hardening means (12).

47. A method for heat treat hardening multiple wear surfaces of a metal workpart (14), said method comprising the steps of:

moving a heating apparatus (34) along a substantially vertical travel path (13) to heat the wear surfaces of the workpart (14);

supporting a surface of the workpart (14) along the travel path (13) for heating thereof by the heating apparatus (34); and moving a fluid quenching apparatus (36) along the vertical travel path (13) immediately following the heating apparatus (34) to quench the heated areas of the workpart (14) whereby the vertical movement of the fluid quenching apparatus (36) prevents excess quenching fluid from pooling on the workpart (14) and unevenly cooling the surface thereof thereby providing even heat treat hardening of the workpart (14).

48. An apparatus (10) for heat treat hardening wear surfaces of a metal workpart (14), said apparatus comprising:

heating means (34) supported for movement along a substantially vertical travel path (13) for heat treating the wear surfaces of the workpart (14);

workpart support means (18) for supporting a surface of the workpart (14) along said vertical travel path (13) for heat treatment thereof by said heating means (34); and quenching means (36) supported directly below said heating means (34) for quenching heated areas on the workpart (14) by immediately following said heating means (34) along said vertical travel path (13) whereby said vertical movement of said quenching means (36) prevents excess quenching fluid from pooling on the workpart (14) and unevenly cooling the surface thereof thereby providing even flame hardening of the workpart (14).

* * * * *